US009831966B2

(12) United States Patent
Tuli

(10) Patent No.: US 9,831,966 B2
(45) Date of Patent: Nov. 28, 2017

(54) METHOD AND DEVICE FOR CONTINUATION OF MULTIMEDIA PLAYBACK

(75) Inventor: Apaar Tuli, Helsinki (FI)

(73) Assignee: Nokia Technologies Oy, Espoo (FI)

( * ) Notice: Subject to any disclaimer, the term of this patent is extended or adjusted under 35 U.S.C. 154(b) by 100 days.

(21) Appl. No.: 12/665,403

(22) PCT Filed: Jun. 18, 2007

(86) PCT No.: PCT/IB2007/001622

§ 371 (c)(1),
(2), (4) Date: Apr. 21, 2010

(87) PCT Pub. No.: WO2008/155595

PCT Pub. Date: Dec. 24, 2008

(65) Prior Publication Data

US 2010/0203823 A1 Aug. 12, 2010

(51) Int. Cl.
*H04H 20/71* (2008.01)
*H04H 20/20* (2008.01)

(52) U.S. Cl.
CPC ..... *H04H 20/20* (2013.01)

(58) Field of Classification Search
CPC ..... H04H 20/20; H04H 20/24
See application file for complete search history.

(56) References Cited

U.S. PATENT DOCUMENTS 6,804,510 B1 10/2004 Bates et al.
6,854,127 B1 * 2/2005 Kanemitsu ..... 725/58
7,197,234 B1 3/2007 Chatterton
7,877,085 B2 * 1/2011 Miyata ..... 455/414.3
2003/0156544 A1 * 8/2003 Ido ..... 370/241
2005/0020202 A1 1/2005 Kobayashi
2005/0153650 A1 7/2005 Hikomoto
2006/0127032 A1 6/2006 van Rooyen
2007/0089132 A1 4/2007 Qureshey et al.
2007/0135087 A1 * 6/2007 Villevieille et al. ..... 455/403
2008/0020702 A1 * 1/2008 Jendbro et al. ..... 455/3.01
(Continued)

FOREIGN PATENT DOCUMENTS

WO WO 01/22633 A1 3/2001
WO WO 2004032493 4/2004
WO WO 2005086624 9/2005

OTHER PUBLICATIONS

International Search Report for Application No. PCT/IB2007/001622 dated Apr. 25, 2008.
(Continued)

*Primary Examiner* — Ayodeji Ayotunde
(74) *Attorney, Agent, or Firm* — Alston & Bird LLP

(57) ABSTRACT

The present invention provides a method for continuation of multimedia playback, comprising receiving a radio broadcast comprising audio and/or video content at a first mobile electronic device, playing back said content, accessing a data connection, searching for a source of said content provided via said data connection, and stopping playback of said content from said radio broadcast and starting playback of said content from said source if at least one source is found. The switching to another content source can also be performed in the opposite direction. The invention also provides devices for performing the multimedia playback continuation method.

32 Claims, 5 Drawing Sheets

(56) References Cited

U.S. PATENT DOCUMENTS

| | | | | |
|---|---|---|---|---|
| 2008/0030618 | A1* | 2/2008 | Okamoto et al. | 348/553 |
| 2008/0233954 | A1* | 9/2008 | Ibrahim et al. | 455/434 |
| 2010/0203823 | A1 | 8/2010 | Apaar | |

OTHER PUBLICATIONS

Office Action for European Application No. 07 76 6557 dated May 8, 2013.
Office Action for European Application No. 07 766 557 dated May 15, 2014.
Written Opinion from International Patent Application No. PCT/IB2007/001622 dated Apr. 25, 2008.

* cited by examiner

METHOD AND DEVICE FOR CONTINUATION OF MULTIMEDIA PLAYBACK

The present invention relates to methods and devices for continued multimedia playback for electronic devices. It particularly relates to continuing playback of multimedia content received from a radio broadcast via a data connection or vice versa in mobile electronic devices.

Frequency Modulation (FM) radio is one of the most widely used features in a mobile device. Newer radio services on mobile devices are rich of features, and allow for exciting interaction possibilities. For example Nokia's "Visual Radio" works along with a "Station Directory Service" (SDS) that lets the users see all details of radio stations in their area. Other examples relating to the reception of multimedia content via a radio broadcast are Digital Video Broadcast Terrestrial (DVB-T), Handheld (DVB-H) or Digital Audio Broadcast (DAB) broadcasts.

FM radio reception, or generally the reception of all multimedia radio broadcasts, is generally poor inside buildings. When users listening to mobile FM radio or other multimedia radio broadcasts enter buildings they potentially suffer a degradation of quality. Many users connect their mobile devices to a Personal Computer (PC), e.g. to synchronize data. Or they connect their mobile devices to a local data network like a private Wireless Local Area Network (WLAN). However, since the PCs and local data networks are usually located indoors, users may face a loss of FM radio sound quality. The reception quality may also decrease in other situations where the radio broadcast signal is attenuated or blocked.

Many content sources like an FM radio station provide digital multimedia streams corresponding to an FM radio broadcast on the Internet. However, there exist no solutions to enable users to continue a multimedia playback using e.g. an Internet connection in an automated manner. The user would have to manually find out if an Internet multimedia source exists for content he is playing back from a radio broadcast on his mobile device, and then manually start playback from this Internet source.

Therefore it is an object of the present invention to provide means for continuing playback of a radio broadcast via a data connection or vice versa without requiring user interaction. This applies to multimedia content for which a corresponding alternative content source is available via a data connection or a radio broadcast, respectively.

SUMMARY OF THE INVENTION

According to a first aspect of the invention a method is provided, comprising:

- receiving a radio broadcast comprising audio and/or video content at a first mobile electronic device;
- playing back said audio and/or video content;
- accessing a data connection;
- searching for a source of said content provided via said data connection; and
- stopping playback of said content from said radio broadcast and starting playback of said content from said source if at least one source is found.

The method of the present invention allows continuing playback of content received via a radio broadcast via an alternative content source over a data connection. For example, a Frequency Modulation (FM) radio broadcast received at a mobile device can be continued using a corresponding Internet radio stream. It should be noted that the term "content" is to be understood in the context of the present invention to include identical as well as substantially similar content. In the aforementioned example the Internet stream carries the same program, although not exactly the same data (analog compared to digital transmission). Also, an Internet stream or other alternative content source may not be time-synchronous with the original radio broadcast. Therefore the alternative source provided over the data connection may have a time offset compared to the radio broadcast.

According to an exemplary embodiment the method further comprises:

monitoring the reception quality of said broadcast;

wherein said stopping and said starting are performed responsive to the reception quality of said broadcast falling below a threshold.

This embodiment allows continuing playback via the alternative source dependent on the reception quality. If the reception quality drops below a pre-determined threshold the playback can be continued from the alternative source over the data connection, e.g. an Internet connection accessed directly by the mobile device (e.g. Wireless Local Area Network WLAN) or via a personal computer the mobile device is connected with. In other exemplary embodiments the switching of the playback source can be triggered manually by a user, i.e. also independent from the reception quality.

According to an exemplary embodiment the method further comprises:

stopping said playback of said content from said source and starting playback of said content from said radio broadcast responsive to the reception quality of said broadcast exceeding a threshold.

This embodiment allows re-initiating the playback at the mobile device, in case the reception quality increases above a pre-determined threshold. This is advantageous due to multiple reasons. If the Internet connection is liable to pay costs, it is advantageous to limit using the Internet connection to situations where the radio broadcast source does not provide a satisfying quality. In mobile devices, it is also possible that accessing the data connection requires higher power consumption than using the radio broadcast. For example, continuing an FM radio broadcast via an Internet stream accessed through a WLAN connection may provide improved quality of the playback while at the same time requiring the mobile device to power up the WLAN transceiver. Therefore, it is also advantageous to limit using the data connection for the provision of the content to situations where the radio broadcast source does not provide a satisfying quality with respect to power consumption.

According to an exemplary embodiment said stopping and said starting are performed responsive to receiving a user command.

Switching from radio broadcast to the data connection for provision of the content can be performed automatically as described above, or manually via a user command. It is possible to use either method for switching (i.e. manually or automatically) as well as in combination. In the latter case, the user is enabled to switch manually even if the radio reception quality is still good enough, for example if he has an Internet flat rate and connects his mobile device to his PC via Universal Serial Bus, so that neither Internet access costs nor power consumption constraints pose a problem. It is also possible to only indicate to the user when an automatically triggered switching is about to be performed, and to actually perform it only responsive to user confirmation.

According to an exemplary embodiment the method further comprises:

stopping playback of said content from said source and starting playback of said content from said radio broadcast responsive to receiving a user command.

This embodiment similarly enables the user to operate switching back to playback from the radio broadcast. Again it is also possible to provide an indication that a switch to radio broadcast is about to be performed, and perform it only upon user confirmation.

According to an exemplary embodiment starting playback of said content from said source is performed at a second electronic device and wherein starting playback of said content from said radio broadcast is performed at said first mobile electronic device.

This embodiment involves a kind of "handing over" the playback from the first mobile device to another electronic device, for example from an FM capable mobile terminal to a personal computer it is connected with via a wired link. The personal computer may not only provide the data connection for the alternative content source, but also have a better sound system (e.g. speakers compared to headphones on the mobile device).

According to an exemplary embodiment said radio broadcast comprises:

a Frequency Modulation, FM, broadcast;

a Digital Audio Broadcast, DAB, broadcast;

a Digital Video Broadcast Terrestrial, DVB-T, broadcast; or a Digital Video Broadcast Handheld, DVB-H, broadcast.

According to an exemplary embodiment said source comprises one of:

an Internet audio and/or video stream;

an audio and/or video receiver card of a computer.

According to this embodiment the source can be an Internet connection, either directly accessed by the mobile electronic device or via a personal computer it is connected with, or also an internal audio/video receiver card of a computer it is connected with. In the latter case it is assumed that the PC has a reception connection via TV cable or a stationary home antenna or like, to provide better reception than the mobile device.

According to an exemplary embodiment searching for a source of said content comprises determining an identification of said radio broadcast or said audio and/or video content and wherein said searching is performed based on said identification. According to exemplary embodiments the identification may be determined from Radio Data System, RDS, meta data;

Radio Text meta data;

Digital Video Broadcast, DVB, meta data;

Nokia Station Directory Service; or

Teletext meta data.

The searching may include performing a database lookup to determine if an alternative source for the content exists. The additional information that is included in the new Radio Text Plus standard can also be used. The Station Directory Service is a service offered by Nokia. It is a server database with details of radio stations around the world that can be queried to derive the identification.

According to a second aspect of the invention a method is provided, comprising:

receiving a data stream comprising audio and/or video content at a first electronic device;

playing back said content;

searching for a radio broadcast source of said content; and stopping playback of said content from said data stream and starting playback of said content from said radio broadcast source if at least one source is found.

The present invention allows continuing playback of content received via a data stream via an alternative content source provided by a radio broadcast. For example, an Internet radio stream received at an electronic device can be continued using a corresponding Frequency Modulation (FM) radio broadcast. It should be noted that the term "content" is to be understood in the context of the present invention to include identical as well as substantially similar content. In the aforementioned example, the radio broadcast carries the same program, although not exactly the same data as the Internet stream (analog compared to digital transmission). Also, the radio broadcast may not be time-synchronous with the Internet stream such that a time offset may be experienced when switching.

According to an exemplary embodiment the method further comprises:

monitoring the reception of said data stream;

wherein said stopping and said starting are performed responsive to the reception of said data stream being discontinued.

According to an exemplary embodiment the method further comprises:

stopping playback of said content from said source and starting playback of said content from said data stream responsive to the reception of said data stream being resumed.

According to an exemplary embodiment said stopping and said starting are performed responsive to receiving a user command.

According to an exemplary embodiment the method further comprises:

stopping playback of said content from said source and starting playback of said content from said data stream responsive to receiving a user command.

According to an exemplary embodiment starting playback of said content from said source is performed at a second mobile electronic device and wherein starting playback of said content from said data stream is performed at said first electronic device.

An example for this embodiment could be a stationary PC as the first electronic device and a mobile electronic device like an mp3 player or other mobile device being capable of FM reception. If the user listens to an Internet radio stream and decides to take a walk, the PC could command the mobile device to tune to a corresponding FM radio station, e.g. via a USB connection between the devices. In this manner the playback is "handed over" to the mobile device.

According to an exemplary embodiment said data stream comprises one of:

an Internet audio and/or video stream;

a data stream from an audio and/or video receiver of said first electronic device.

According to an exemplary embodiment said radio broadcast comprises:

a Frequency Modulation, FM, broadcast;

a Digital Audio Broadcast, DAB, broadcast;

a Digital Video Broadcast Terrestrial, DVB-T, broadcast; or a Digital Video Broadcast Handheld, DVB-H, broadcast.

According to an exemplary embodiment searching for a source of said content comprises determining an identification of said data stream or said audio and/or video content and wherein said searching is performed based on said identification. According to exemplary embodiments the indication can be obtained from:

Radio Data System, RDS, meta data;

Radio Text meta data;

Digital Video Broadcast, DVB, meta data;

meta data included in an Internet audio and/or video stream; or

Teletext meta data.

According to a third aspect of the invention a computer program product is provided, comprising program code means for carrying out the method described above when said program product is run on an electronic device. In an exemplary embodiment the program code means may be stored on a computer-readable medium.

According to a fourth aspect of the invention a mobile electronic device is provided, comprising:

a radio receiver adapted for receiving a radio broadcast comprising audio and/or video content;

a playback component adapted for playing back said content;

a data connection interface;

a controller adapted for accessing a data connection, searching a source of said content provided via said data connection, stopping playback of said content from said radio broadcast and starting playback of said content from said source if at least one source is found.

According to an exemplary embodiment said controller is further adapted for monitoring the reception quality of said broadcast and for performing said stopping and said starting of said playback responsive to the reception quality of said broadcast falling below a threshold. The term "monitoring the reception quality" is to be understood as also including a case where it becomes impossible to listen to FM radio because the user doesn't have the external antenna (usually included in the headphones) with him right away. In this case, when the user tries to play a particular channel from his stored favorites, the device can inform the user that the corresponding Internet radio stream of the station will be played, because FM playback is impossible due to the missing antenna. When the user pulls out the external antenna while listening to FM radio the device can also switch to the Internet stream automatically.

According to an exemplary embodiment said controller is further adapted for stopping playback of said content from said source and starting playback of said content from said radio broadcast responsive to the reception quality of said broadcast exceeding a threshold.

According to an exemplary embodiment said device further comprises:

a user interface;

wherein said controller is further adapted for performing said stopping and said starting of said playback responsive to a user command received via said user interface.

In another exemplary embodiment said controller is further adapted for stopping said playback of said content from said source and starting said playback of said content from said radio broadcast responsive to a user command received via said user interface.

In another exemplary embodiment said controller is adapted for performing said starting of playback of said content from said source by transmitting a command to start playback of said content from said source to a second electronic device via said data connection, and for starting playback of said content from said radio broadcast at said mobile electronic device responsive to a command received via said data connection.

In another exemplary embodiment said radio receiver comprises:

a Frequency Modulation, FM, receiver;

a Digital Audio Broadcast, DAB, receiver;

a Digital Video Broadcast Terrestrial, DVB-T, receiver; or a Digital Video Broadcast Handheld, DVB-H, receiver.

In another exemplary embodiment said data connection interface comprises:

a Universal Serial Bus interface;

an Ethernet interface;

a Wireless Local Area Network, WLAN, interface;

a cellular packet data interface; or a Bluetooth interface.

In another exemplary embodiment said controller is further adapted for determining an identification of said radio broadcast or said audio and/or video content and for performing said searching based on said identification.

In another exemplary embodiment said identification is determined from:

Radio Data System meta data;

Radio Text meta data;

Digital Video Broadcast meta data;

Nokia Station Directory Service; or

Teletext meta data.

According to a fifth aspect of the invention an electronic device is provided, comprising:

a data connection interface adapted for receiving a data stream comprising audio and/or video content;

a playback component adapted for playing back said content;

a radio receiver adapted for receiving radio broadcasts;

a controller adapted for searching a radio broadcast source of said content, stopping playback of said content from said data stream and starting playback of said content from said source if at least one source is found.

According to an exemplary embodiment said controller is further adapted for monitoring the reception of said data stream and for performing said stopping and said starting responsive to the reception of said data stream being discontinued.

According to an exemplary embodiment said controller is further adapted for stopping playback of said content from said source and starting playback of said content from said data stream responsive to the reception of said data stream being resumed.

According to an exemplary embodiment the device further comprises:

a user interface;

wherein said controller is further adapted for performing said stopping and said starting of said playback responsive to a user command received via said user interface.

According to an exemplary embodiment the device further comprises:

a user interface;

wherein said controller is further adapted for stopping playback of said content from said source and starting playback of said content from said data stream responsive to a user command received via said user interface.

According to an exemplary embodiment said controller is adapted for performing said starting of playback of said content from said source by transmitting a command to start playback of said content from said source to a mobile electronic device via said data connection, and for starting playback of said content from said data stream responsive to a command received via said data connection.

According to an exemplary embodiment said radio receiver comprises:

a Frequency Modulation, FM, receiver;
a Digital Audio Broadcast, DAB, receiver;
a Digital Video Broadcast Terrestrial, DVB-T, receiver; or
a Digital Video Broadcast Handheld, DVB-H, receiver.

According to an exemplary embodiment said data connection interface comprises:
a Universal Serial Bus interface;
an Ethernet interface;
a Wireless Local Area Network, WLAN, interface;
a cellular packet data interface;
a Digital Subscriber Line, DSL, interface; or
a Bluetooth interface.

According to an exemplary embodiment said controller is further adapted for determining an identification of said data stream or said audio and/or video content and for performing said searching based on said identification. In exemplary embodiments the identification is determined from:
Radio Data System meta data;
Radio Text meta data;
Digital Video Broadcast meta data;
meta data included in an Internet audio and/or video stream; or
Teletext meta data.

According to a sixth aspect of the invention an apparatus is provided, comprising:
means for receiving a radio broadcast comprising audio and/or video content;
means for playing back said audio and/or video content;
means for accessing a data connection;
means for searching for a source of said content provided via said data connection;
means for stopping playback of said content from said radio broadcast; and
means for starting playback of said content from said source if at least one source is found.

According to a seventh aspect of the invention an apparatus is provided, comprising:
means for receiving a data stream comprising audio and/or video content; means for playing back said content;
means for searching for a radio broadcast source of said content;
means for stopping playback of said content from said data stream; and
means for starting playback of said content from said radio broadcast source if at least one source is found.

BRIEF DESCRIPTION OF THE DRAWINGS

The invention can be more fully understood by the following detailed description of exemplary embodiments, when also referring to the drawings, which are provided in an exemplary manner only and are not intended to limit the invention to any particular embodiment illustrated therein. In the drawings

It is to be noted that elements from different embodiments are not limited to be used only in the particular embodiment in conjunction of which they are described, but may also be combined with elements from other embodiments.

DETAILED DESCRIPTION OF EXEMPLARY EMBODIMENTS

It should be noted that the following detailed description will focus on examples wherein the radio broadcast is an analog FM radio broadcast, and the data connection is an Internet connection. However, it will be appreciated that these are just examples used to illustrate the invention. The invention can be used with other radio broadcasts and other data connections as well.

Figure 1:
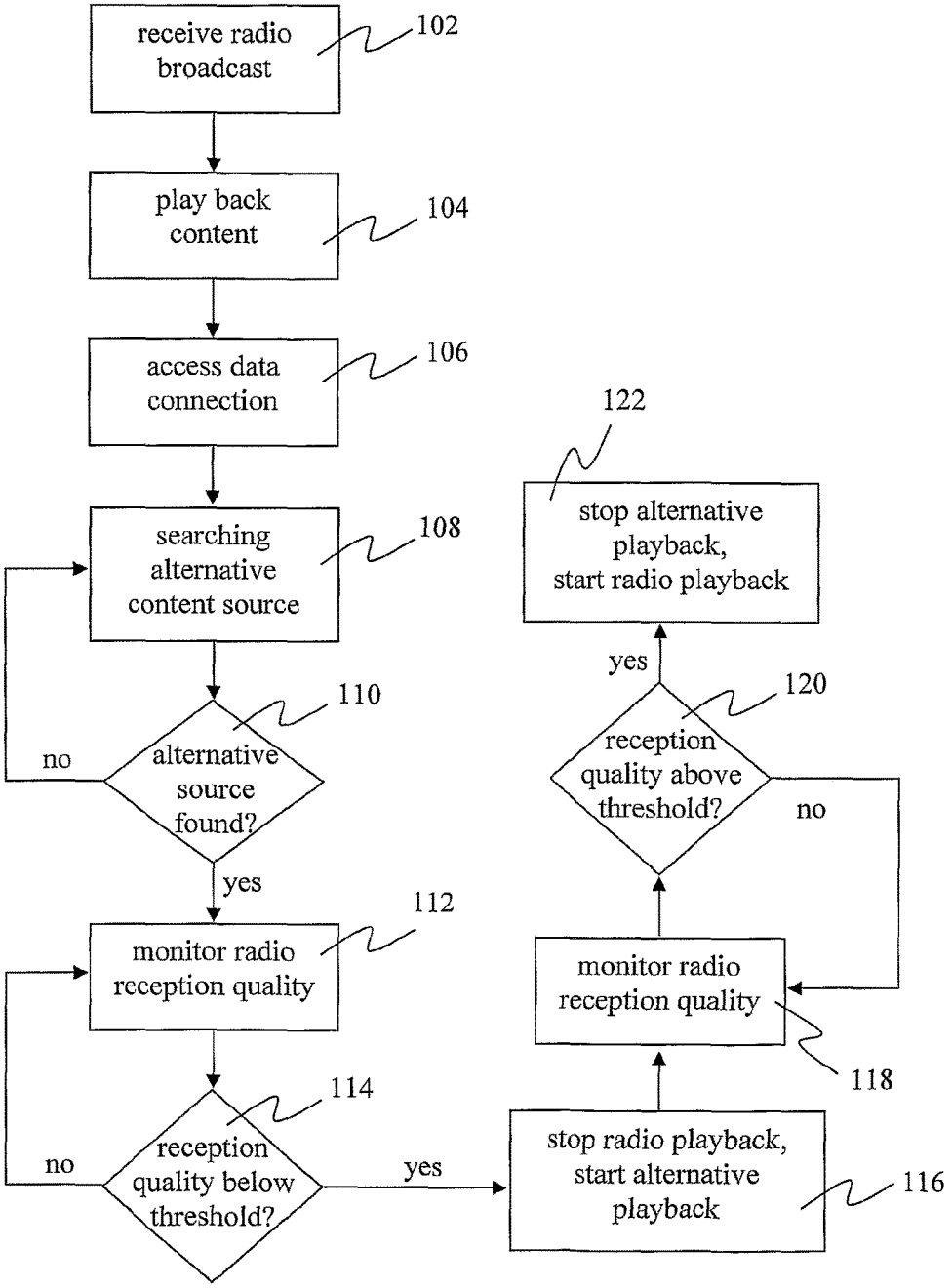
FIG. 1 is a flow diagram illustrating the steps of an exemplary embodiment of the invention.

FIG. 1 shows the steps of an exemplary embodiment of the inventive method. In step 102 a radio broadcast is received by a mobile electronic device, for example a program from a station called "ApTu Radio" on a radio frequency of 95.2 MHz. The mobile electronic device could e.g. be an FM capable mobile telephone. Playback of the content is performed in step 104, e.g. via a set of headphones connected with the mobile phone. In step 106 a data connection is accessed. Examples of such data connections include, but are not limited to, an Internet connection (e.g. accessed via WLAN, Ethernet, GPRS) and a connection with a personal computer (e.g. via USB, Bluetooth).

On or via this data connection an alternative source for the currently played back content is searched in step 108. This can e.g. be accomplished by performing an Internet search for an audio stream corresponding to the analog FM radio program "ApTu Radio", or a search for a corresponding source on the connected PC. The device can try to connect to ApTu radio's website, wherein the information about the web site could be provided by Radio Text Plus meta data, and for example find a Really Simple Syndication, RSS, feed. From the RSS feed it may be able to extract the station's radio stream Universal Resource Locator, URL. The latter can include searching for an FM receiver card installed in the PC that can be used to receive "ApTu Radio" via a cable connection or other reliable content source. If a source is not found ("no" in step 110) the search is repeated.

Otherwise the process proceeds with step 112, where the radio reception quality of the internal receiver of the mobile device is monitored. If the reception quality drops below a pre-determined threshold in step 114, the process continues in step 116. Otherwise the monitoring is continued in step 112. It is to be noted that steps 108, 110 and 112, 114 must not be performed in the illustrated order, but can also be performed in another order, or also simultaneously. If an alternative source has been found, and if the reception quality drops below the threshold, the radio playback is stopped, and playback is re-started from the found alternative source in step 116. In other exemplary embodiments the switching to the alternative source can also be performed as soon as possible after accessing the data connection, regardless of the FM reception quality or a user command.

Re-starting the playback from the alternative source (that might be an Internet radio stream) may include to pre-buffer the content provided by the alternative source. This could take some time, e.g. 10 seconds for an Internet radio stream, until the actual playback can be started. The pre-buffering (not shown in the figure) can be performed after an alternative source has been found, e.g. directly after step 110 in FIG. 1, or it can be started when the radio reception quality drops below a certain level. In the latter case this level is chosen appropriately such that radio playback is likely not to be interrupted immediately upon falling below the level, such that it is likely that enough time will be left while the radio playback continues to pre-buffer enough of the content from the alternative source to be able to start playback upon the radio reception failing.

It is to be noted that the re-starting of the playback can be performed in the mobile electronic device itself or at another device, e.g. a personal computer connected with the mobile device. In the latter case the re-starting may include transmitting a corresponding command to the computer to take over playback. This re-starting may be regarded as a kind of "handover" of the playback from the mobile to another (e.g. stationary) electronic device. In other embodiments the re-starting is performed in the mobile device itself, i.e. the playback from the FM radio source is stopped, and playback is restarted from an Internet stream via WLAN, Bluetooth or General Packet Radio System GPRS.

In step 118 the radio reception quality is further monitored. If in step 120 it is detected that the radio reception quality has (again) increased above a pre-determined threshold, the process continues with step 122. It is to be noted that the pre-determined thresholds in steps 114 and 120 must not necessarily have the same value, although this is also possible. In order to improve the switching behavior the threshold in step 120 can be set slightly higher than that in step 114 (i.e. using a kind of hysteresis). In step 122 the playback from the alternative source is stopped again, and the radio playback is resumed. This is particularly advantageous in mobile devices where using the data connection (e.g. GPRS, WLAN, Bluetooth etc.) would entail a higher power consumption than FM reception, due to the required powering up of the respective transceiver and decoding stages.

In exemplary embodiments, additionally a user notification can be provided before step 116 and 122, respectively, indicating to the user that switching of the content source is intended. The notification can be passive only, i.e. without requiring and/or enabling user interaction. In advanced embodiments the actual switching as of steps 116 or 122 can be made dependent on corresponding user confirmation. This is particularly useful for situations where using the data connection would incur additional costs for the user that he might not be willing to accept. In even further advanced embodiments the notification and confirmation can be provided only for data connections incurring such costs, e.g. GRPS, while the switching of the playback source is performed without user interaction when the data connection is free of (additional) charge, like an Internet flat rate accessed via a home WLAN. It is to be noted that additional to or in replacement of the automatic switching a manual user input can be provided to trigger the switching.

Figure 2:
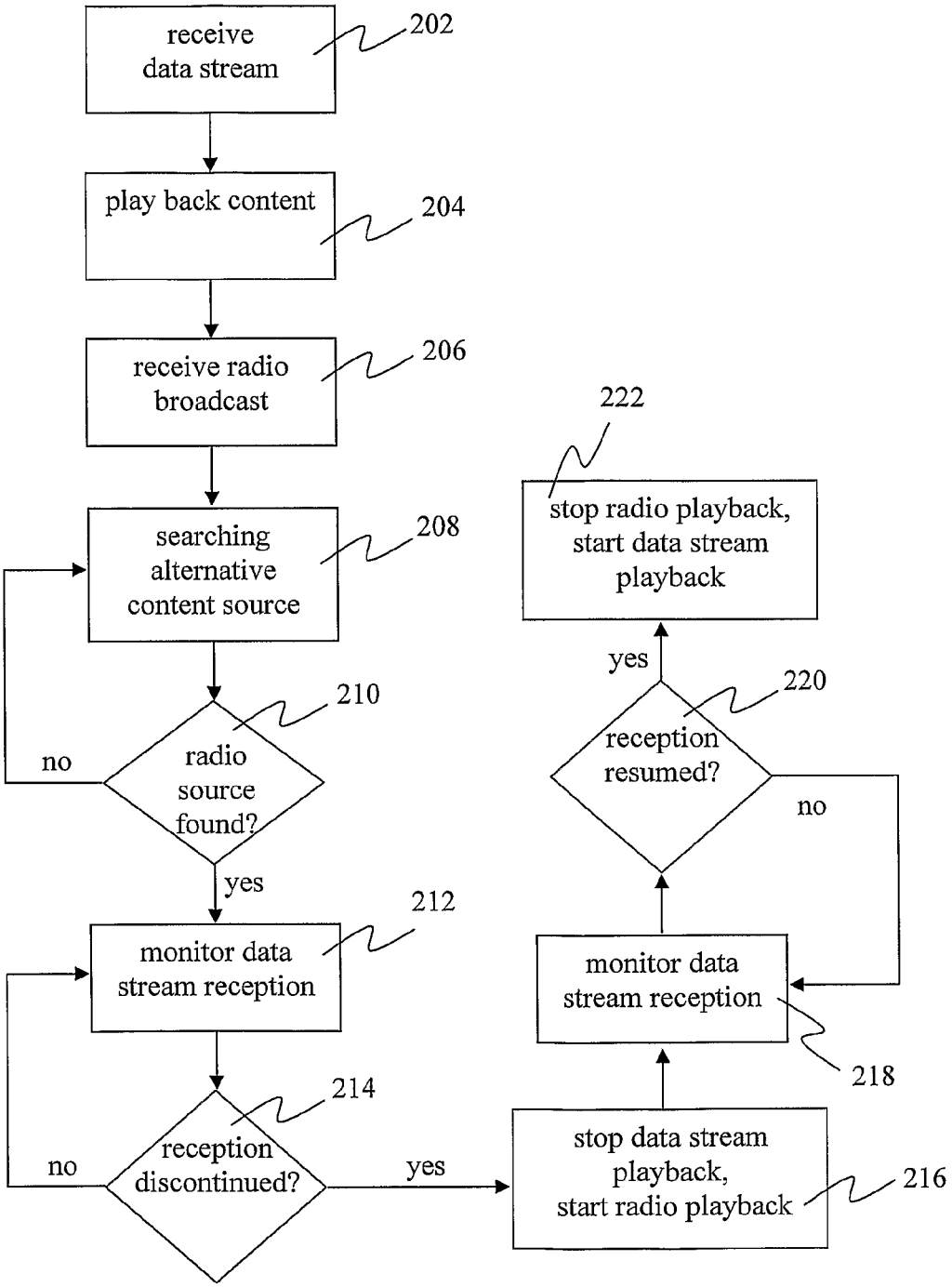
FIG. 2 is a flow diagram illustrating the steps of an alternative exemplary embodiment of the invention.

FIG. 2 shows the steps of another exemplary embodiment of the inventive method. The invention can not only be employed to continue radio broadcast content playback at a mobile device via an alternative source (e.g. Internet stream), but also in the "opposite" direction. An example for the former could be a mobile electronic device receiving FM radio and switching to a corresponding Internet radio stream when in range of a shared private Internet connection like a home WLAN network. An example for the "opposite" direction could be a laptop computer that is connected with a home WLAN network and plays back an Internet radio stream, and that switches—upon being transported to a different location without the WLAN coverage—to a corresponding FM radio broadcast received via an internal or connected FM receiver. For example a student uses the laptop at home to listen to Internet radio and then carries it to some location outside of his home Internet connection (or generally any accessible Internet connection). The laptop would then automatically search for a corresponding FM radio station using its FM receiver.

In step 202 a data stream is received, for example Internet radio, but also including other data streams like the video stream from a DVB-T/S receiver in a computer. In step 204 the content is played back. In step 206 a radio broadcast is received that is used (in step 208) to search for alternative sources for the content. In case a radio broadcast source is found in step 210, the process continues in step 212, otherwise it returns to step 208. In step 212 the reception of the data stream is monitored. If the data stream reception is discontinued (in step 214), the process continues with step 216, otherwise it returns to step 212. It should be noted that steps 206 to 212 can also be performed in a different succession. For example the search for new sources via radio can be started after the data stream reception has been discontinued. In this case a short interruption of playback may occur. In case the playback of the data stream includes buffering a certain amount of the content (e.g. an Internet radio stream), the interruption may be minimized if a new source is found within the play time of the remaining buffered content.

In step 216 the data stream playback is stopped, and the radio playback is started. In step 218 the data stream reception is further monitored, and in case the reception is resumed (in step 220), the process continues with step 222. In step 222 the radio playback is stopped again, and data stream playback is resumed. It is to be noted that additional to or in replacement of the automatic switching a manual user input can be provided to trigger the switching.

The following is another example of the inventive method. A user is listening to an FM radio broadcast on his mobile device while driving a car. As the user drives out of the city limits, the quality of the FM signal begins to deteriorate. The mobile device detects the deteriorating signal. The device gets information from a radio station database (such as Nokia's Station Discovery Service) to check if a corresponding internet radio station exists for that particular FM radio station. The device might have prefetched this information from the database when the user initially tuned in to the FM station. The mobile device uses the Universal Resource Locator URL provided to it through the radio station database and starts buffering the radio stream via Internet radio streaming protocol. Once it has buffered the required amount of data, it smoothly fades out the FM radio broadcast, and fades in the Internet radio broadcast of the same station. The user can now continue listening to the same radio station even though not being within the broadcasting limits of the FM channel itself. The medium of transmission has changed almost seamlessly (taken into account that there may be a time offset between the two content sources that can not be compensated).

Therefore, in exemplary embodiments the mobile device could detect when there is a more or less silent period in the playback and perform the switching preferably then, to minimized the audio distortion for the user. This could be detected by monitoring when the volume level drops below a threshold. Even more preferably the detection of silent passages could be made for the data connection source as well, and the switching could be timed to be made when both sources are substantially quiet.

Figure 3:
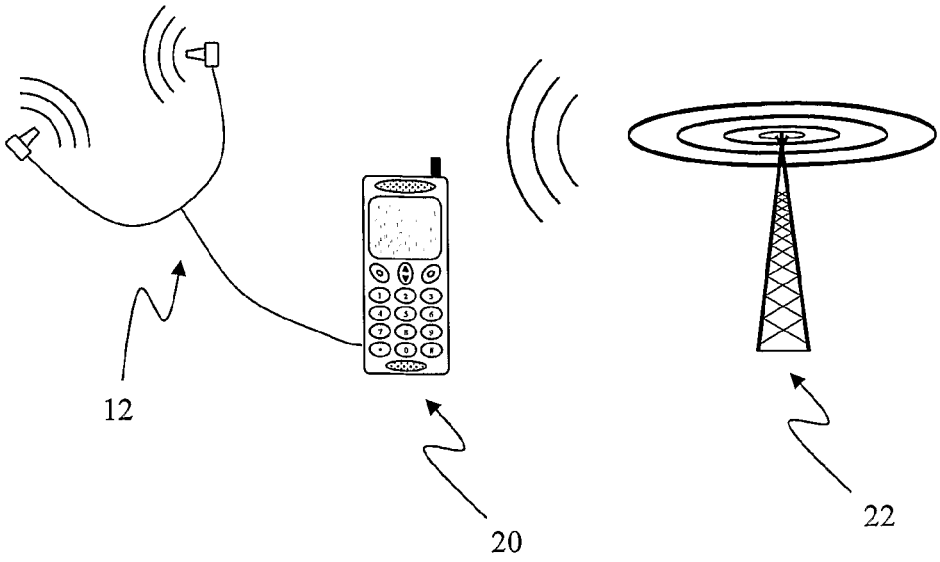
FIG. 3 shows a schematic view of an embodiment of the invention.
Figure 4:
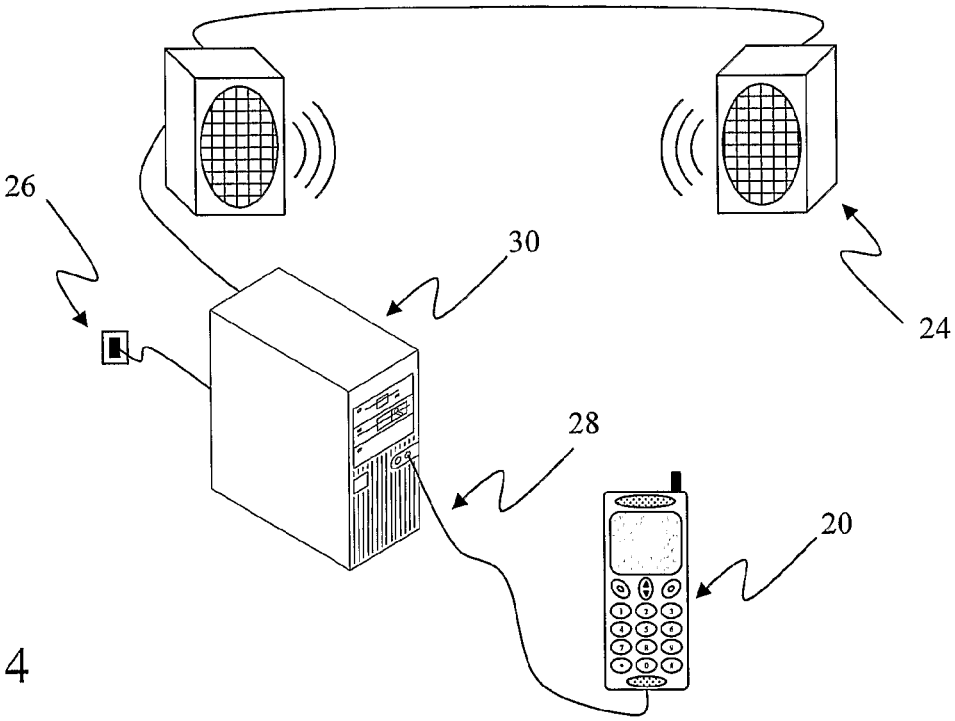
FIG. 4 shows a schematic view of another embodiment of the invention.

FIGS. 3 and 4 show another example of the switching between content sources according to the invention. In FIG. 3 a mobile device 20 is depicted, receiving an FM radio broadcast from a radio station 22. The FM radio broadcast could also be any other radio-based multimedia transmission, e.g. DVB-T, DVB-H or DAB. The mobile device 20 performs playback of the content received via the FM radio broadcast via attached headphones 12. Playback can be accomplished by other means like an internal speaker or like.

In case the FM reception quality deteriorates beyond an acceptable threshold, or generally if another source for substantially the content becomes available, e.g. when connecting the mobile device 20 to a PC 30, the playback is switched to this other sources. This situation, i.e. after switching, is shown in FIG. 4. The mobile device 20 is connected with a personal computer 30, e.g. via a wired USB connection 28. Other examples of data connections may include WLAN and Bluetooth. The personal computer 30 itself is connected with the Internet, indicated by the connection with the wall socket 26, e.g. via a Digital Subscriber Line DSL. It also comprises a pair of loudspeakers 24 acting as an audio playback means. The mobile device 20 has searched for a new source for the original FM broadcast using the PC's Internet connection, and it is assumed that it has found an Internet stream providing the same program as the FM broadcast.

Furthermore, according to an advanced embodiment, the mobile device 20 has also determined that the PC 30 provides a better playback means, e.g. sound system 24, than the mobile device 20 can offer. Therefore the playback is not only continued using the Internet stream, but even "handed over" to the PC 30, in order to make use of the superior playback quality of the loudspeakers 24. It is to be noted that in case of video content visual presentation means like an internal display of the mobile device and a monitor of the PC may be involved in the playback of the content.

Figure 5:
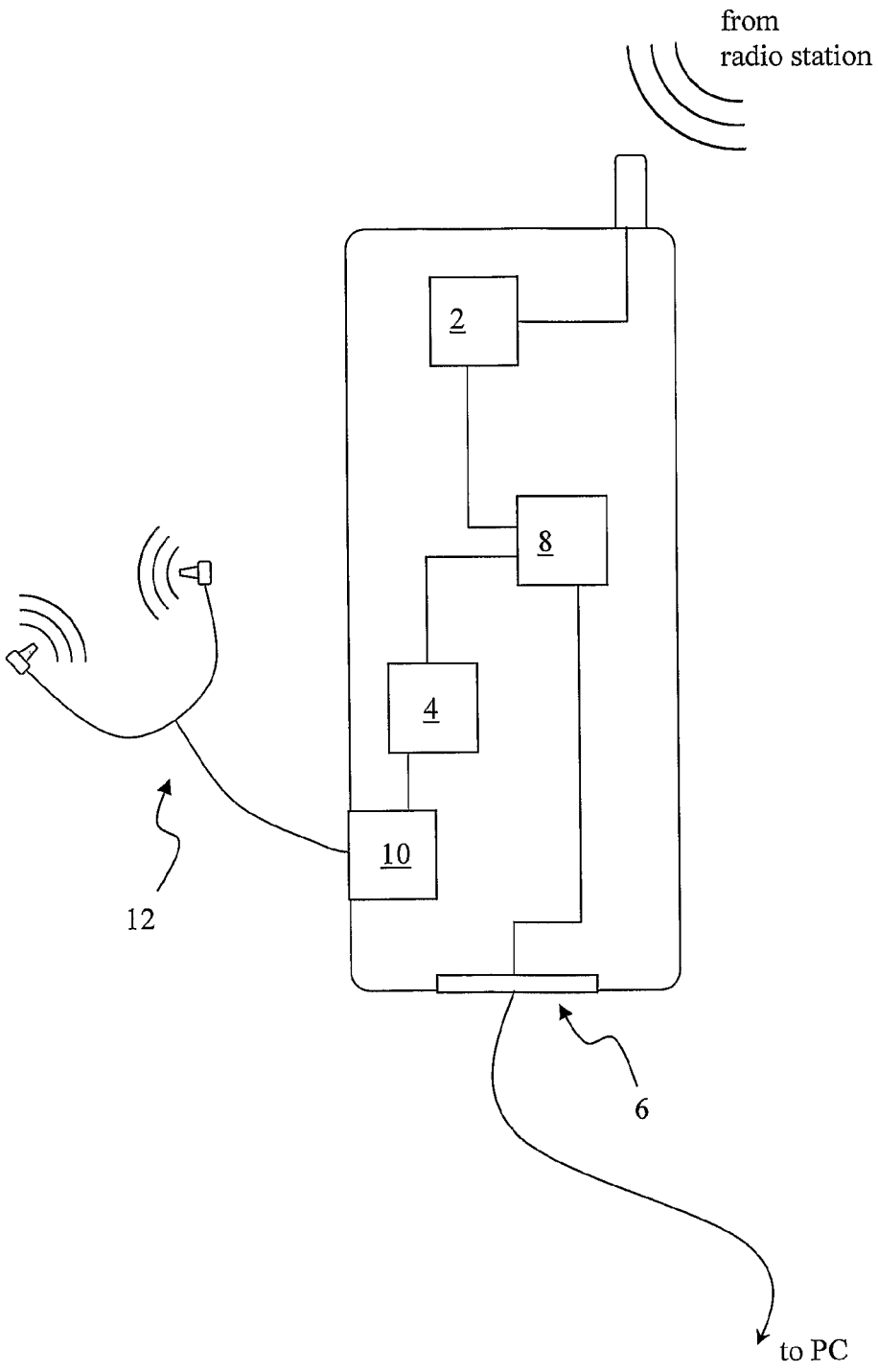
FIG. 5 shows a schematic view of components of an embodiment of the invention.

In FIG. 5 a schematic view of elements of an electronic device 20 according to an embodiment of the present invention is illustrated. The device 20 comprises a radio receiver 2 including a corresponding antenna, for receiving radio broadcasts like FM radio, DVB-T, DVB-H or DAB. A playback component 4 is provided, e.g. an FM radio circuit, for playing back the content received by the receiver 4. In cases of digital reception like DVB-T the playback component 4 will include the required decoder stages. A playback interface 10 is provided, e.g. in form of a headphone socket. In case of video content the playback interface can include a display or like (not shown). The device 20 further comprises a data connection interface 6 for accessing a data connection, e.g. in form of a USB interface. A controller 8 is provided for controlling the device. A user interface (not shown) can be provided, e.g. a keypad of mobile device 20.

The controller 8 is adapted for searching alternative sources of the content received via the receiver 2, using data connection interface 6. For example interface 6 may be connected to a personal computer and share the computer's Internet connection for searching an audio stream corresponding to the FM or other radio broadcast. In case such alternative source is found, the controller 8 is adapted to perform a switching to start playback from this alternative source instead of the radio broadcast. The switching can be performed responsive to establishment of the data connection, i.e. immediately when an alternative source is found after connection. The controller 8 can be adapted to monitor the radio reception quality, and to perform the switching responsive to the radio reception quality dropping below a threshold (assumed that an alternative source is available). The controller 8 can further be adapted to notify a user that a switching is intended and to either perform the switching without waiting for user interaction or only if the user confirms switching via the user interface.

In exemplary embodiments of the invention the transition from playback based on a radio broadcast to playback based on a data stream is performed in a single mobile electronic device. An example for such a device could be a mobile phone or personal digital assistant, having both an FM radio interface as well as a data connection interface like WLAN, enabling the device to access Internet radio streams by itself. This Internet access could e.g. be accomplished via a private WLAN access point within the user's home or a public WLAN hotspot in a café, at a train station or like. The mobile device performs the playback by itself, e.g. via a stereo headset. It is to be noted that a personal computer could somehow "mediate" the connection, e.g. in case the data connection is performed via a USB connection between the PC and the mobile device. However, also in this case the mobile device would access the Internet radio stream by itself.

Figure 6:
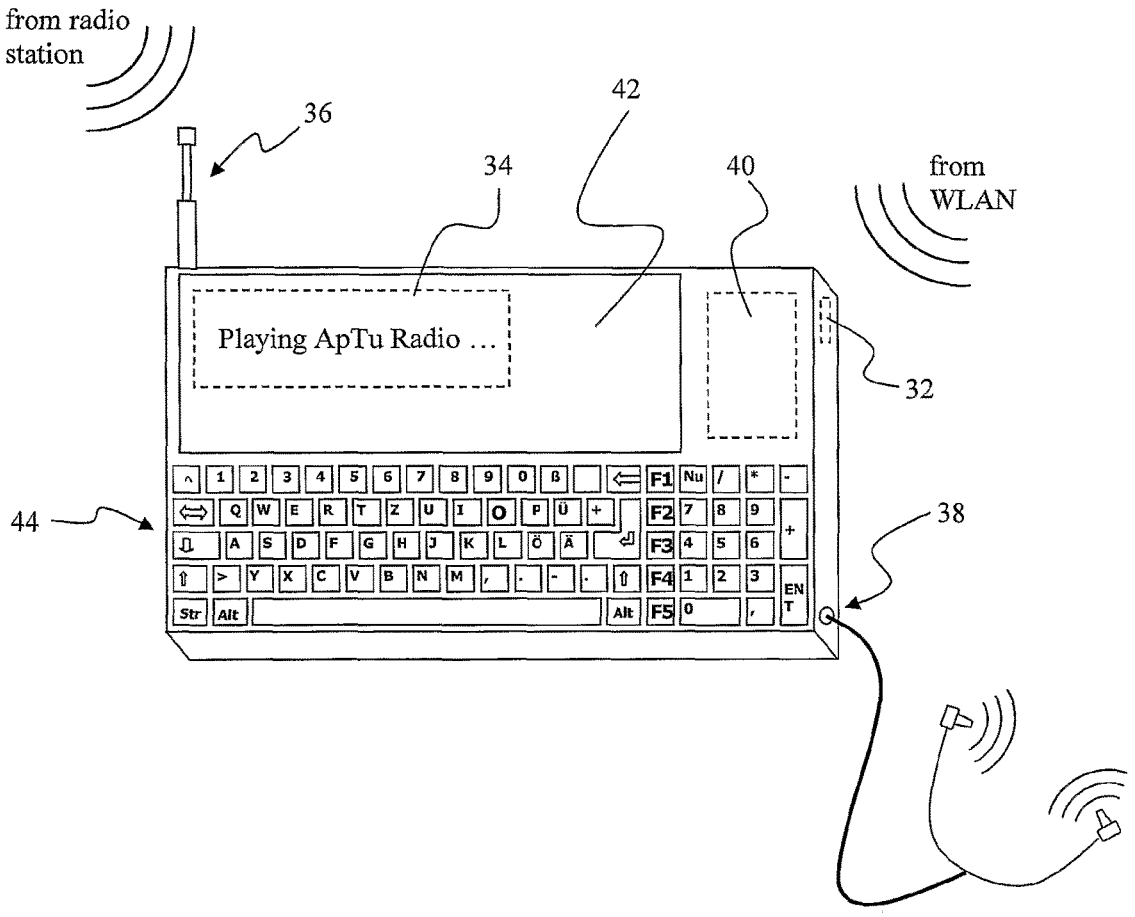
FIG. 6 shows a schematic view of components of another embodiment of the invention.

In FIG. 6 a schematic view of elements of an electronic device according to an embodiment of the present invention is illustrated. The device can e.g. be a laptop, handheld computer or a similar device, including also stationary desktop computers. The device comprises a radio receiver 36 including a corresponding antenna, for receiving radio broadcasts like FM radio, DVB-T, DVB-H or DAB. A playback component 34 is provided, e.g. an FM radio circuit, for playing back the content received by the receiver 36. In cases of digital reception like DVB-T the playback component 34 will include the required decoder stages. A playback interface 38 is provided, e.g. in form of a headphone socket. The electronic device can include a display 42, e.g. for video content, or for displaying additional information for audio-only content. The device further comprises a data connection interface 32 for accessing a data connection, e.g. in form of a WLAN interface. A controller 40 is provided for controlling the device. The device comprises a user interface 44 in form of a keyboard.

The controller 40 is adapted for searching alternative radio broadcast sources of the content received via the data connection interface 32 (here indicated by "ApTu radio"), using the radio receiver 36. In case such alternative source is found, the controller 40 is adapted to perform a switching to start playback from this alternative source instead of the radio broadcast. The controller 40 can be adapted to monitor the data stream (indicated by "from WLAN") reception, and to perform the switching responsive to the data stream reception being discontinued, e.g. when leaving the coverage area of the WLAN. The controller 40 can further be adapted to notify a user, e.g. via the display 42 that a switching is intended and to either perform the switching without waiting for user interaction or only if the user confirms switching via the user interface 44.

In exemplary embodiments of the invention the transition from playback based on a data stream to playback from a radio broadcast is performed in a single (possibly also mobile) electronic device. An example for such a device could be a laptop or handheld computer, having both an FM radio interface as well as a data connection interface like WLAN, enabling the device to access Internet radio streams and corresponding FM radio broadcasts by itself. The Internet access could e.g. be accomplished via a private WLAN access point within the user's home or a public WLAN hotspot in a café, at a train station or like. The device performs the playback by itself, e.g. via a stereo headset.

In other exemplary embodiments two different devices are involved in the playback transition, e.g. a PC and mobile electronic device as described just above. According to these embodiments the mobile device does "hand over" the audio/video playback to the PC, either directly upon connection (provided an alternative source can be found), responsive to a user command or when the reception quality of the mobile device's internal radio receiver drops below an acceptable threshold. In this case there would need to be an Internet radio software installed on the PC, or generally a software for playing back content provided via a data stream.

In advanced embodiments the PC could also share any other multimedia access means it comprises with the mobile device, like an analog TV or FM radio receiver card, digital audio and/or video card like DVB (terrestrial, satellite or cable). The invention only requires that an application for playing back the same or substantially the same content is present on the PC that can take over playback from the connected mobile device.

In these embodiments the playback would not only be transferred from radio broadcast to data stream, but also the playback would be transferred from the mobile devices speakers, headphones or like to the PC's sound system, e.g. a connected surround sound set or Hifi equipment. When the user connects his PC and his mobile device (using any suitable wired/wireless method) the mobile device can instruct the PC to start streaming a particular channel.

A possible use case could be as follows:

1) The user is listening to FM radio on his mobile device
2) The user connects his mobile device to his PC
3) A PC application recognizes what is currently playing on the mobile device's FM radio or is correspondingly informed by the mobile device
4) The PC application checks, e.g. from the Station Directory Service, SDS, if a corresponding Internet stream is available
5) If yes, the PC application starts streaming the same program via the Internet stream
6) Optionally, the PC application instructs the mobile device to stop playing the FM broadcast This PC application could be integrated into a connection/synchronization application for mobile phones or like devices, for example as the Nokia PC Suite. The mobile device could also locate and provide an Internet radio streaming address like http://13.245.67.89:80/stream/0815 or http://some_ip_number:8000/listen.pls to the PC and let the operating system choose with which application to play back the stream.

The invention claimed is:

1. Method, comprising:

receiving a radio broadcast comprising audio content at a first mobile electronic device;

playing back said content received from said radio broadcast;

accessing a digital data connection;

searching for a source of said content providing the same content as received from said radio broadcast, via said digital data connection; and stopping playback of said content from said radio broadcast and causing playback to be started of said same content from said source if at least one source is found, wherein said stopping playback of said content from said radio broadcast and causing playback to be started of said same content from said source is performed when a more or less silent period is detected in the playback received from said radio broadcast and is detected for the digital data connection source as well, wherein a more or less silent period is detected in the playback received from said radio broadcast when a volume level of the playback is below a threshold and a more or less silent period is detected for the digital data connection source when a volume level of the content received from the digital data connection source is below said threshold.

2. Method according to claim 1, wherein said stopping and said starting are performed responsive to receiving a user command.

3. Method according to claim 1, comprising stopping playback of said content from said source and starting playback of said content from said radio broadcast responsive to receiving a user command.

4. Method according to claim 1, wherein said source comprises one of:

an Internet audio or video stream;

an audio or video receiver of a second electronic device.

5. Method according to claim 1, wherein searching for a source of said content comprises determining an identification of said radio broadcast or said audio or video content and wherein said searching is performed based on said identification.

6. Method according to claim 5, wherein said identification is determined from:

Radio Data System, RDS, meta data;

Radio Text meta data;

Digital Video Broadcast, DVB, meta data;

Nokia Station Directory Service; or

Teletext meta data.

7. Method, comprising:

receiving a digital data stream comprising audio content via a digital data connection at a first electronic device;

playing back said content received via said digital data stream;

searching for a radio broadcast source of the same content, as received via said digital data stream; and stopping playback of said content from said digital data stream and causing playback to be started of said same content received from said radio broadcast source if at least one radio broadcast source is found, wherein said stopping playback of said content from said digital data stream and causing playback to be started of said same content from said radio broadcast source is performed when a more or less silent period is detected in the playback received from said digital data stream and is detected for the radio broadcast source as well, wherein a more or less silent period is detected in the playback received from said digital data stream when a volume level of the playback is below a threshold and a more or less silent period is detected for the radio broadcast source when a volume level of the content received from the radio broadcast source is below said threshold.

8. Method according to claim 7, wherein said stopping and said starting are performed responsive to receiving a user command.

9. Method according to claim 7, comprising:

stopping playback of said content from said source and starting playback of said content from said data stream responsive to receiving a user command.

10. Method according to claim 7, wherein said data stream comprises one of:

an Internet audio or video stream;

a data stream from an audio or video receiver of said first electronic device.

11. Method according to claim 7, wherein searching for a source of said content comprises determining an identification of said data stream or said audio or video content and wherein said searching is performed based on said identification.

12. Method according to claim 11, wherein said identification is determined from:

Radio Data System, RDS, meta data;

Radio Text meta data;

Digital Video Broadcast, DVB, meta data;

meta data included in an Internet audio or video stream; or

Teletext meta data.

13. Computer program product stored on a non-transitory computer-readable medium, comprising code that when executed causes a first mobile electronic device to receive a radio broadcast comprising audio content at said first mobile electronic device;

play back said content received via said radio broadcast;

access a digital data connection;

search for a source providing the same content as received from said radio broadcast via said digital data connection; and stop playback of said content from said radio broadcast and cause playback to be started of said same content received from said source if at least one source is found, wherein said stopping playback of said content from said radio broadcast and causing playback to be started of said same content from said source is performed when a more or less silent period is detected in the playback received from said radio broadcast and is detected for the digital data connection source as well, wherein a more or less silent period is detected in the playback received from said radio broadcast when a volume level of the playback is below a threshold and a more or less silent period is detected for the digital data connection source when a volume level of a content received from the digital data connection source is below said threshold.

14. Mobile electronic device, comprising:

a radio receiver configured to receive a radio broadcast comprising audio content;

a playback component configured to play back said content, received via said radio broadcast;

a digital data connection interface; and a controller configured to access a digital data connection, search for a source of said content providing the same content as received from said radio broadcast via said digital data connection, stop playback of said content from said radio broadcast and cause playback to be started of said same content received from said source if at least one source is found, wherein said controller is configured to perform said stopping playback of said content from said radio broadcast and causing playback to be started when a more or less silent period is detected in the playback received from said radio broadcast and is detected for the digital data connection source as well, wherein the controller is configured to detect a more or less silent period in the playback received from said radio broadcast when a volume level of the playback is below a threshold and to detect a more or less silent period for the digital data connection source when a volume level of the content received from the digital data connection source is below said threshold.

15. Device according to claim 14, further comprising:

a user interface;

wherein said controller is further configured to perform said stopping and said starting of said playback responsive to a user command received via said user interface.

16. Device according to claim 14, comprising:

a user interface;

wherein said controller is further configured to stop playback of said content from said source and start playback of said content from said radio broadcast responsive to a user command received via said user interface.

17. Device according to claim 14, wherein said controller is further configured to determine an identification of said radio broadcast or said audio or video content and to perform said searching based on said identification.

18. Device according to claim 17, wherein said identification is determined from:

Radio Data System meta data;

Radio Text meta data;

Digital Video Broadcast meta data;

Nokia Station Directory Service; or

Teletext meta data.

19. Electronic device, comprising:

a digital data connection interface configured to receive a digital data stream comprising audio content;

a playback component configured to play back said content;

a radio receiver configured to receive radio broadcasts; and a controller configured to search a radio broadcast source of the same content as said played back digital data stream, stop playback of said content from said digital data stream and cause playback to be started of said same content from said radio broadcast if at least one radio broadcast is found, wherein said controller is configured to perform said stopping playback of said content from said digital data stream and causing playback to be started of said same content from said radio broadcast source when a more or less silent period is detected in the playback received from said digital data stream and is detected for the radio broadcast source as well, wherein the controller is configured to detect a more or less silent period in the playback received from said digital data stream when a volume level of the playback is below a threshold and to detect a more or less silent period for the radio broadcast source when a volume level of the content received from the radio broadcast source is below said threshold.

20. Device according to claim 19, further comprising:

a user interface;

wherein said controller is further configured to perform said stopping and said starting of said playback responsive to a user command received via said user interface.

21. Device according to claim 19, comprising:

a user interface;

wherein said controller is further configured to stop playback of said content from said source and start playback of said content from said data stream responsive to a user command received via said user interface.

22. Device according to claim 19, wherein said controller is further configured to determine an identification of said data stream or said audio or video content and to perform said searching based on said identification.

23. Device according to claim 22, wherein said identification is determined from:

Radio Data System meta data;

Radio Text meta data;

Digital Video Broadcast meta data;

meta data included in an Internet audio or video stream; or

Teletext meta data.

24. Apparatus, comprising:

means for receiving a radio broadcast comprising audio content;

means for playing back said audio or video content received via said radio broadcast;

means for accessing a digital data connection;

means for searching for a source providing the same content as received via said radio broadcast via said digital data connection;

means for stopping playback of said content from said radio broadcast;

means for causing playback to be started of said same content received from said source if at least one source is found; and means for performing said stopping playback of said content from said radio broadcast and causing playback to be started when a more or less silent period is detected in the playback received from said radio broadcast and is detected for the digital data connection source as well, wherein a more or less silent period is detected in the playback received from said radio broadcast when a volume level of the playback is below a threshold and a more or less silent period is detected for the digital data connection source when a volume level of the content received from the digital data connection source is below said threshold.

25. Apparatus, comprising:

means for receiving a digital data stream comprising audio content;

means for playing back said content;

means for searching for a radio broadcast source of the same content as received via said digital data stream;

means for stopping playback of said content from said digital data stream;

means for causing playback to be started of said same content from said radio broadcast source if at least one radio broadcast source providing said same content is found; and means for performing said stopping playback of said content from said digital data stream and causing playback to be started of said same content received from said radio broadcast source when a more or less silent period is detected in the playback received from said digital data stream and is detected for the radio broadcast as well, wherein a more or less silent period is detected in the playback received from said digital data stream when a volume level of the playback is below a threshold and a more or less silent period is detected for the radio broadcast source when a volume level of the content received from the radio broadcast source is below said threshold.

26. Method according to claim 1, wherein said radio broadcast comprises:

a Frequency Modulation, FM, broadcast;

a Digital Audio Broadcast, DAB, broadcast;

a Digital Video Broadcast Terrestrial, DVB-T, broadcast; or a Digital Video Broadcast Handheld, DVB-H, broadcast.

27. Method according to claim 7, wherein said radio broadcast comprises:

a Frequency Modulation, FM, broadcast;

a Digital Audio Broadcast, DAB, broadcast;

a Digital Video Broadcast Terrestrial, DVB-T, broadcast; or a Digital Video Broadcast Handheld, DVB-H, broadcast.

28. Device according to claim 14, wherein said radio receiver comprises:

a Frequency Modulation, FM, receiver;

a Digital Audio Broadcast, DAB, receiver;

a Digital Video Broadcast Terrestrial, DVB-T, receiver; or a Digital Video Broadcast Handheld, DVB-H, receiver.

29. Device according to claim 14, wherein said data connection interface comprises:

a Universal Serial Bus interface;

an Ethernet interface;

a Wireless Local Area Network, WLAN, interface;

a cellular packet data interface; or a Bluetooth interface.

30. Device according to claim 19, wherein said radio receiver comprises:

a Frequency Modulation, FM, receiver;

a Digital Audio Broadcast, DAB, receiver;

a Digital Video Broadcast Terrestrial, DVB-T, receiver; or a Digital Video Broadcast Handheld, DVB-H, receiver.

31. Device according to claim 19, wherein said data connection interface comprises:

a Universal Serial Bus interface;

an Ethernet interface;

a Wireless Local Area Network, WLAN, interface;

a cellular packet data interface;

a Digital Subscriber Line, DSL, interface; or a Bluetooth interface.

32. A computer program product stored on a non-transitory computer-readable medium, comprising code that when executed causes a first electronic device to:

receive a digital data stream comprising audio content via a digital data connection at the first electronic device;

play back said content received via said digital data stream;

search for a radio broadcast source of the same content, as received via said digital data stream; and stop playback of said content from said digital data stream and causing playback to be started of said same content received from said radio broadcast source if at least one radio broadcast source is found, wherein said stopping playback of said content from said digital data stream and causing playback to be started of said same content from said radio broadcast source is performed when a more or less silent period is detected in the playback received from said digital data stream and is detected for the radio broadcast source as well, wherein a more or less silent period is detected in the playback received from said digital data stream when a volume level of the playback is below a threshold and a more or less silent period is detected for the radio broadcast source when a volume level of the content received from the radio broadcast source is below said threshold.

* * * * *